United States Patent [19]

Jasper

[11] 3,952,818

[45] Apr. 27, 1976

[54] GROOVING BUCKET

[75] Inventor: Terence George Jasper, Sydney, Australia

[73] Assignee: Frankipile Australia Pty Limited, Australia

[22] Filed: Nov. 7, 1974

[21] Appl. No.: 521,628

[30] Foreign Application Priority Data

Dec. 21, 1973 Australia ..... 6083/73
July 10, 1974 Australia ..... 71450/74

[52] U.S. Cl. ..... 175/277; 61/53.6
[51] Int. Cl.[2] ..... E21B 9/26
[58] Field of Search ..... 175/277, 291, 292, 308, 175/173, 202, 290; 61/53.6

[56] References Cited

UNITED STATES PATENTS

| | | | |
|---|---|---|---|
| 165,376 | 7/1875 | Summers | 175/292 |
| 1,133,398 | 3/1915 | Pippin | 175/277 |
| 2,228,709 | 1/1941 | Ruddell et al. | 175/291 |
| 2,585,369 | 2/1952 | Caruthers | 175/277 |
| 2,621,898 | 12/1952 | Brodhead et al. | 175/292 |

FOREIGN PATENTS OR APPLICATIONS

| | | | |
|---|---|---|---|
| 489,332 | 1954 | Italy | 175/292 |

*Primary Examiner*—Ernest R. Purser
*Attorney, Agent, or Firm*—Crisman & Moore

[57] ABSTRACT

A grooving bucket for forming grooves or bells in the ground around a previously drilled hole to allow casting of a concrete pile, the grooving bucket consisting of a cylindrical bucket portion fitted at the upper end with a boot or connecting box to fit the appropriate drilling machine kelly bar. Pivoted cutter arms protrude from each side of the bucket and are held in the horizontal or cutting position preferably by heavy duty tension springs. The cutters are hollow or channeled and are angled to cut a groove or bell in the ground on rotation of the bucket and to lead spoil or rock cuttings into the interior of the bucket. The bucket may be provided with a bottom hinged door to facilitate removal of spoil from inside the bucket.

15 Claims, 7 Drawing Figures

GROOVING BUCKET

Figure 2:
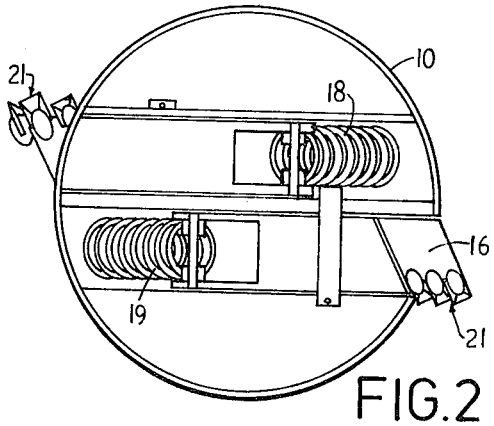

The present invention relates to a grooving bucket which may be described as a form of belling tool for use in forming grooves in holes drilled in the ground for the reception of concrete piles.

In the drilling of holes for cast-in-situ concrete piles it is the practise to use a belling tool to form grooves in the ground around the drilled hole or socket to provide an anchorage for the pile against longitudinal movement. Known belling tools require very high end loads on the tool to provide the necessary digging action, particularly where shale or clay sockets are belled.

The object of the present invention is to provide a grooving bucket for this purpose, which does not require a high end load and which facilitates the provision of multiple bells or grooves in the hole and further enables the hole to be drilled to full depth and then grooved, rather than as at present, by interupting the drilling operation at intervals to form the grooves. It is considered that this procedure will result in a saving in costs.

The invention consists in a grooving bucket for forming grooves or bells in the ground around a hole or socket that has been drilled into the ground to allow casting of a concrete pile the grooving bucket comprising a cylindrical bucket portion adapted to be attached to a drilling machine, there being provided within the bucket portion at least one cutter which is movably mounted so as to be movable from a retracted position in which the cutter lie wholly within the circumference of the bucket portion, to a cutting position in which the cutter projects substantially radially from the circumference of the bucket, characterized in that the cutter is held in the retracted position by means of a removable wedge and in that the cutter is movable from the retracted position to the cutting position by means of at least one tension spring attached to the cutter, and wherein the cutter is shaped to cut a groove or bell in the ground on rotation of the bucket and to lead spoil into the interior of the bucket.

Preferably the bucket is fabricated with a tubular steel body, with a door hinged at its lower end to facilitate removal of spoil or rock cuttings from inside the bucket. Preferably, there are means for releasing the door from the exterior of the bucket. The bucket can be adapted to be attached to a drilling machine by means of a boot or connecting box fitted at the upper end of the bucket adapted to fit onto the appropriate drilling machine kelly bar.

There are preferably two movably mounted diametrically opposed cutters or cutter arms which can be pivotally mounted within the bucket, mounted so as to be movable from a retracted position in which they lie wholly within the circumference of the bucket portion to a cutting position in which they project substantially, and preferably, radially from the circumference of the bucket, preferably at 90° to the longitudinal axis of the bucket portion. The walls of the bucket portion can be provided with suitably shaped apertures through which the cutters may protrude.

The cutters may be held in their operative position by means of heavy duty tension springs which may have means for adjusting the tension such as spring tension adjusting bolts. Any suitable means are used for releasing the cutters from their retracted position inside the bucket to their operative position. Preferably cam-operated means are provided for this purpose in association with operative means for controlling the cam from ground level when the bucket is in use in a drill hole. More preferably a cam-operated lever and a ratchet wedge, controlled by means of a nylon rope-extending from the cam lever to the operator at ground level-are used to release the cutters from their retracted positions.

The cutters are of a suitable design to lead spoil or rock cuttings into the interior of the bucket. Preferably the cutters are channelled or are hollow to enable spoil or rock cuttings to pass through them and into the bucket. The cutters are suitably angled to lead spoil through the cutters and into the bucket, and the cutters may have chamferred faces adapted to form a Vee-shaped groove around the circumference of the drill hole. The cutting edges of the cutters may be provided with removable cutting teeth.

Figure 1:
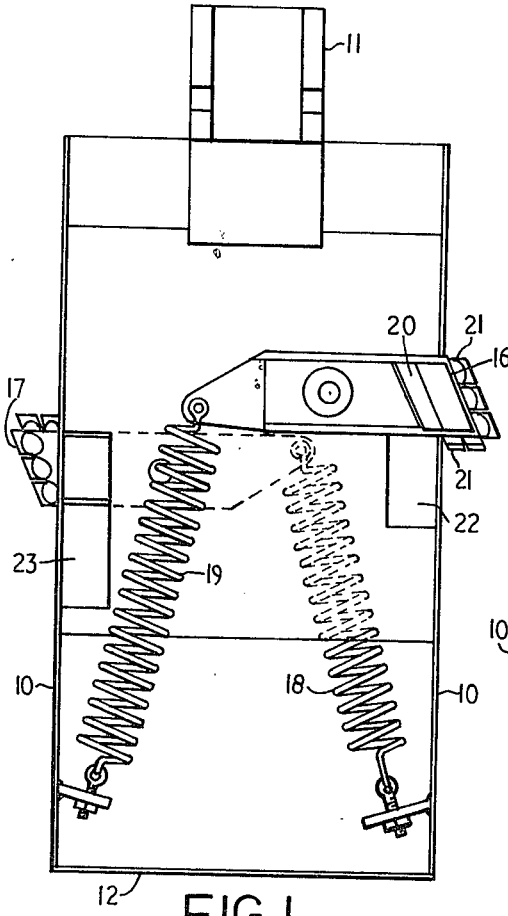
Figure 3:
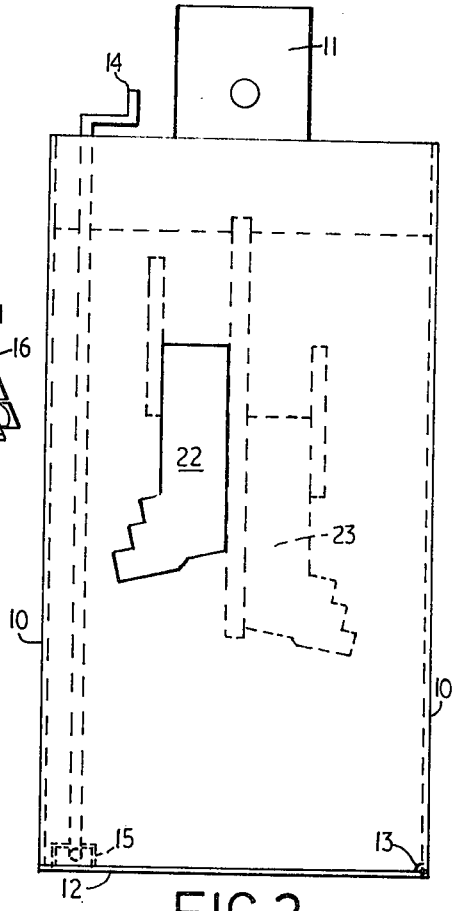
Figure 4:
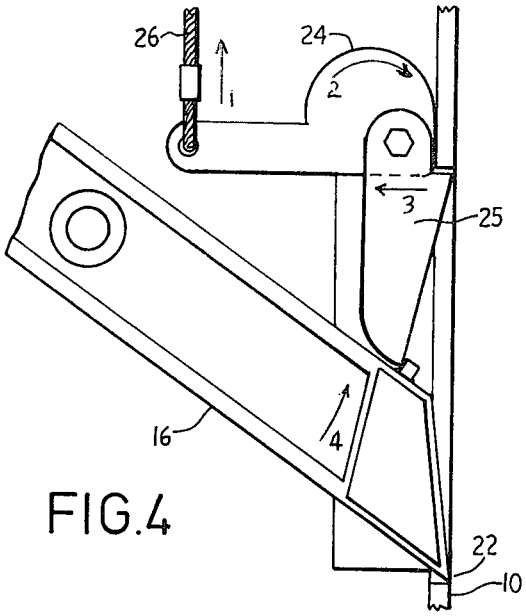
Figure 5C:
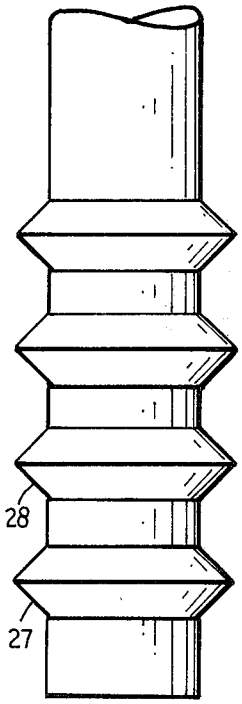
Figure 5B:
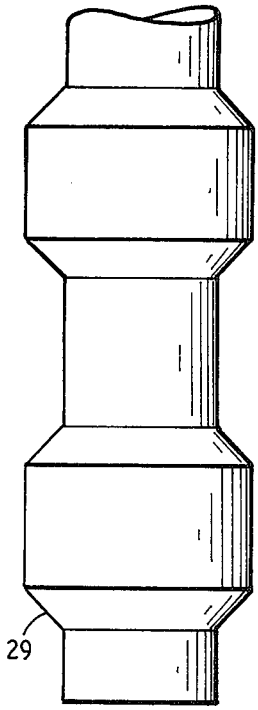
Figure 5A:
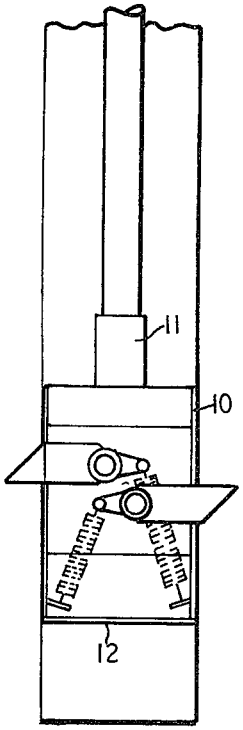

In order that the nature of the invention may be better understood a preferred form thereof is hereinafter described by way of example, with reference to the accompanying drawings in which:

FIG. 1 is a sectional elevation of a grooving bucket according to the invention, FIG. 2 is a plan view thereof, FIG. 3 is an elevation of the bucket when rotated through 90° from the position shown in FIG. 1, FIG. 4 is a view to an enlarged scale of a removable cam device, by means of which the cutters can be caused to project from the bucket, and FIG. 5*a* is a sectional side elevational view of the bucket of FIG. 1 positioned in a hole for grooving;

FIG. 5*b* is a sectional side elevational view of the hole of FIG. 5*a* after one form of grooving therein; and FIG. 5*c* is a sectional side elevational view of the hole of FIG. 5*a* after another form of grooving therein.

The bucket consists of a cylindrical casing 10 to the upper end of which is attached a boot or connecting box 11 by means of which the bucket may be attached to the kelly bar of a drilling machine. At the lower end of the bucket is a door 12 hinged to the cylindrical casing by a hinge 13 which facilitates the removal of spoil or rock cuttings entering the bucket, the door 12 being secured or released by means of the bolt 14, which is adapted to co-operate with a door catch 15.

Within the bucket are two pivotally mounted cutters 16 and 17 which normally are held in the position shown in FIGS. 1 and 2, in which they project from the circumference of the bucket, by means of coil springs 18 and 19. The lower cutter 17 has a chamferred face which faces downwardly and which is adapted to form the bottom half of the profile of a groove. Similarly the upper cutter 16 has an upwardly directed sloping face which shapes the upper half of the profile of the groove. The effect produced by these faces can be readily seen in the views shown in FIGS. 5*a*, 5*b* and 5*c* of grooves produced by the tool. The cutters 16 and 17 are hollow so that material cut by them passes through the spoil feed 20 of the cutter and into the interior of the casing 10 of the bucket. The cutters are angled or sloped to lead spoil into the interior of the bucket; this can be seen in FIG. 2. The cutting edges of the cutters are provided with replaceable cutting teeth 21.

In FIG. 3 are shown the apertures 22 and 23 to which the tools 16 and 17 respectively project when in the cutting position and into which they may be retracted.

The bucket is used by attaching it to the kelly bar of a drilling machine and introducing it into a hole that has already been drilled. In order to enable this to be done it is necessary for the cutters 16 and 17 to be held in the retracted position and the manner in which this is done is illustrated in FIG. 4. In this Figure, the cutter 16 is seen held in the retracted position by means of an assembly consisting of a cam lever 24, a wedge 25 and a cord 26 which extends to the surface of the ground. When in the position shown the assembly is held in this configuration by the pressure exerted by the spring 18 which causes the cutter 16 to jamb the wedge 25 against the edge of the aperture 22 in the casing 10. If the cord is pulled, the cam lever 24 is caused to rotate in the direction of the arrow 2; this causes the wedge 25 to move in the direction of the arrow 3 and to become disengaged from the edge of the aperture 22. The whole assembly is then freed and may be drawn to the surface in the direction of the arrow 1. Once the wedge 25 has been removed the cutter 16 moves in the direction of the arrow 4 to take up the position shown in FIG. 1.

In use the grooving bucket is lowered to the bottom of the predrilled hole, the cutters are freed by removal of the mechanisms described above and the bucket is rotated. As the bucket rotates, the springs 18 and 19 will cause the cutters 16 and 17 to extend gradually outwardly cutting into the side of the hole as they do to form a groove such as that indicated at 27 in FIG. 5*c*, the sloping faces of the cutters producing the vee-shape of the groove. If the second groove 28 is to be formed rotation is stopped and the drill stem is pulled upwardly a suitable distance. The action of pulling it upwardly causes the cutter blades to bear against the strata and/or temporary/permanent steel liner, which may be used to line the predrilled hole, and such action causes the cutting blades to be forced within the circumference of the casing 10 against the force of springs 18 and 19. When rotation is resumed the cutters gradually move outwardly under the force of the springs and cut a groove such as 28.

If it is desired to cut a double-large groove such as that indicated at 29 in FIG. 5*b* the cutters 16 and 17 are maintained in the outwardly extending position while the drill stem is rotated to cut the parallel sided portion of the large groove.

The material cut away by the cutters 16 and 17 passes through the spoil feed 20 and into the casing 10 of the bucket which when filled is drawn to the surface and emptied through the door 12. The bucket is then reintroduced into the hole in the manner described above.

The embodiment of the invention described is given by way of example only, as constituting a preferred form of the invention within the general scope thereof as defined above.

What is claimed is:

1. A grooving bucket for forming grooves or bells in the ground around a hole or socket that has been drilled into the ground to allow casting of a concrete pile, said grooving bucket comprising a cylindrical bucket portion adapted to be attached to a drilling machine, there being provided within the bucket portion at least one cutter which is movably mounted so as to be movable from a retracted position in which said cutter lies wholly within the circumference of the bucket portion, to a cutting position in which said cutter projects substantially radially from the circumference of the bucket, said cutter being held in the retracted position by means of a removable wedge and said cutter being movable from the retracted position to the cutting position by means of at least one tension spring attached to said cutter, and wherein said cutter is shaped to cause spoil to be led into the interiors of the bucket during the rotation of said bucket to cut a groove in the ground.

2. A grooving bucket as claimed in claim 1 wherein there are two cutters substantially diametrically opposed.

3. A grooving bucket as claimed in claim 2 wherein the cutters are channeled to allow spoil to pass therethrough.

4. A grooving bucket as claimed in claim 3 wherein the cutters are provided with chamferred faces adapted to cut vee-shaped grooves around the circumference of the drilled hole.

5. A grooving bucket as claimed in claim 4 wherein the cutters are provided with removable cutting teeth.

6. A grooving bucket as claimed in claim 2 wherein the cutters are hollow to allow spoil to pass therethrough.

7. A grooving bucket as claimed in claim 6 wherein the cutters are provided with chamferred faces adapted to cut vee-shaped grooves around the circumference of the drilled hole.

8. A grooving bucket as claimed in claim 7 wherein the cutters are provided with removable cutting teeth.

9. A grooving bucket as claimed in claim 1 wherein said cutter is pivotally mounted inside the bucket portion.

10. A grooving bucket as claimed in claim 1 wherein the removable wedge has a camming surface adapted to operate so as to facilitate removal of the wedge.

11. A grooving bucket as claimed in claim 10 wherein means are provided to operate the cam lever externally of the bucket to release the wedge.

12. A grooving bucket as claimed in claim 11 wherein the wedge is removable from the interior of the bucket portion.

13. A grooving bucket as claimed in claim 10 wherein the removable wedge comprises a wedge member adapted to hold the cutter in the retracted position, said wedge member being pivotally mounted on a cam lever adapted to operate so as to release the wedge member.

14. A grooving bucket as claimed in claim 1 which also includes an aperture formed through the wall thereof and wherein the wedge holds the cutter in the retracted position by means of a step cut into the wedge adapted to cooperate with the top edge of the aperture in the bucket portion through which the said cutter protrudes when in the cutting position.

15. A grooving bucket as claimed in claim 1 which also includes a hinged door for removal of spoil from the bucket.

* * * * *